US010136782B2

(12) United States Patent
Spinelli

(10) Patent No.: US 10,136,782 B2
(45) Date of Patent: Nov. 27, 2018

(54) MULTI-FUNCTION COMBINED BRUSH FOR VACUUM CLEANER

(71) Applicant: Spival S.P.A., Larciano (PT) (IT)

(72) Inventor: Paolo Spinelli, Larciano (IT)

(73) Assignee: Spival S.P.A., Larciano (PT) (IT)

( * ) Notice: Subject to any disclaimer, the term of this patent is extended or adjusted under 35 U.S.C. 154(b) by 316 days.

(21) Appl. No.: 15/037,745

(22) PCT Filed: Aug. 28, 2014

(86) PCT No.: PCT/IB2014/064115
§ 371 (c)(1),
(2) Date: May 19, 2016

(87) PCT Pub. No.: WO2015/075572
PCT Pub. Date: May 28, 2015

(65) Prior Publication Data

US 2016/0302635 A1 Oct. 20, 2016

(30) Foreign Application Priority Data

Nov. 19, 2013 (IT) ..... FI2013A0278

(51) Int. Cl.
*A47L 9/06* (2006.01)
*A47L 7/00* (2006.01)

(52) U.S. Cl.
CPC ..... *A47L 9/0653* (2013.01); *A47L 7/0004* (2013.01)

(58) Field of Classification Search
CPC ..... A47L 7/004; A47L 9/0653; A47L 9/06
USPC ..... 15/39, 415.18
See application file for complete search history.

(56) References Cited

U.S. PATENT DOCUMENTS

2004/0216267 A1 11/2004 Kaffenberger

FOREIGN PATENT DOCUMENTS

| | | | |
|---|---|---|---|
| DE | 2005500 | A1 | 8/1971 |
| FR | 2345127 | A1 | 10/1977 |
| GB | 851185 | A | 10/1960 |
| GB | 2026310 | A | 2/1980 |
| GB | 2063657 | A | 6/1981 |

OTHER PUBLICATIONS

Int'l Search Report and Written Opinion, PCT/IB2014/064115, dated Jan. 20, 2015.

*Primary Examiner* — David Redding
(74) *Attorney, Agent, or Firm* — Nancy J. Flint, Attorney at Law, P.A.; Nancy J. Flint, Esq.

(57) ABSTRACT

Multi-function combined brush (1) for vacuum cleaner. A brush (1) for vacuum cleaner of a "combined" type, i.e. a brush (1) capable of changing the operating mode without being obliged to replace the accessory, whose main feature consists of its possibility of alternating its functions, for instance carpets, floors, and liquids, by way of a pedal (7) featuring one static position. Very advantageously, the innovative solution according to the present application makes it possible to embody a combined brush (1) capable of performing different functions in one device.

21 Claims, 7 Drawing Sheets

MULTI-FUNCTION COMBINED BRUSH FOR VACUUM CLEANER

TECHNICAL FIELD

The present invention belongs to the sector of the brushes for vacuum cleaners. More specifically, this invention concerns cleaning brush and accessories equipped with retractile elements.

PRESENT STATUS OF THE ART

It is known that the devices used for home cleaning, for instance the vacuum cleaners, operate on the basis of the principle of creating a vacuum and a consequent flow of atmospheric air toward said vacuum, which results in the particles of dust being carried by the so created flow.

Particularly complete clearing machines also exist and are known, which generate steam and make it expand and direct toward the surface to be cleaned, thus leaving humidity and water which are sucked by the machine itself by using the same vacuum device as used to suck dust; in this case the brush is often equipped with rubber blades, which are used to keep the water to suck within a confined environment.

The brushes for cleaning equipment vary in accordance with their specific application and with the surface where they shall be used. Therefore, there are brushes specially suited for floors, for carpets, for parquet floors, for sofas, or others. Further, there are brushes specially suited for suction only, for liquids, for steam, or mixed. Their variants are actually even more numerous and possibly also offer other features including, for instance, the presence and the type of small wheels that facilitate the displacement or the handling of the brushes as well as of the cleaning elements.

In order to make it possible the use of several cleaning features in one brush, there is, in general, the following alternative: according to a first option, the accessory of interest is mounted on a basic brush every time it is required, whereas the second option consists of using a so called "combined" brush. A bush of the latter type comprises a bottom plate, usually of a type suitable for carpets, and a retractable accessory, usually one or several bristles for floors and one or several blades for liquids.

In combined brushes, a pedal operates a number of mechanisms which, alternatively, lower and lift the frame that the accessory of interest is connected to. The frame is usually located in a raised position thanks to the action of one or several springs.

Different kinematic mechanisms have been progressively developed over years to move these frames; however the variants known so far always features two working positions only, so one accessory only can be lifted or extracted downwards, alternatively.

Examples of these devices are described in DE 3737749 A1, in GB 1311079 A, in GB 1343962 A, in DE19818568 C1, in WO 2009128762 A1 and in DE 2005500 A1.

Some devices have also been developed which, thanks to specially designed moving mechanisms, make it possible to obtain different operating modes, for instance U.S. Pat. No. 2,034,196 A, U.S. Pat. No. 3,821,831 A, and EP 0158145 A1.

However, these devices do not really allow to use more than two accessories, but rather they allow to set a plurality of different working positions for each individual accessory, so as to determine slightly different operating modes.

For instance, U.S. Pat. No. 3,821,831 A, even though it offers the possibility of selecting three different positions, in fact allows to position the one and same accessory in two different arrangements, in correspondence with which said accessory is more or less extracted.

On the contrary, the device according to the present patent application makes it possible to have several accessories mounted on the same brush, so as to set operating modes really different from each other; for instance, by extracting brushes to clean floors or by extracting blades for liquids or by even holding both the bristles and the blades inside the brush body, so as to use the bottom plate only, for instance to clean carpets.

Moreover, the brush configuration described below does not require any separate external accessories, hence it is easier to use than those described above.

PURPOSES AND SUMMARY OF THE INVENTION

The solutions illustrated in the present patent application solve the problems described above by means of a shaft (4) which rotates intermittently to cause the alternate translation of one or several movable frames, preferably two or more frames, so that the latter pass from a position retracted with respect to the fixed part (2) and an extracted position and vice versa.

Thanks to the solutions adopted, it is possible to have a combined brush (1) capable of matching several operating modes by simply depressing one pedal (7).

More specifically, the combined brush (1) according to the present patent application comprises a fixed part (2) and one or several frames, preferably two or more frames, that are movable with respect to said fixed part.

Said one or several movable frames hold the desired accessories that characterize each specific operating mode, besides making it possible to set special configurations that make specific improvements possible, for instance in sucking given zones. In other words, there might be a frame to clean floors, another for carpets, another one to suck liquids, and so on.

Furthermore, said fixed part (2) can be properly shaped or be equipped with accessories, so as to provide a first operating mode.

Said one or several movable frames move from a retracted position, in which the accessory does not operate, to a working position; therefore, the retracted position corresponds to the raised position of the frame whereas the extracted or blocked position corresponds to the lower position thereof.

It is known that the retracted position is usually held by means of at least one return spring (13), an end being connected to its corresponding movable frame.

In the device according to the present patent application, the intermittent rotation of said shaft (4) results in subsequently operating at least one different movable frame, so as to change the operating mode.

As a matter of fact, the rotation of the shaft acts onto appropriate mechanisms, which force a translatory motion in said at least one different movable frame. Said mechanisms make it possible to realize a kinematic mechanism that links the rotation of said shaft (4) to the translation of a movable frame. Such kinematic mechanism can be implemented by means of a kinematic pair in which motion takes place between two properly shaped profiles in contact with each other or by using any other equivalent kinematic mechanism, for instance a thrust crank gear.

In other words, a first rotation of said shaft (4) makes it possible to extract a frame and its corresponding accessory, whereas a further rotation makes the just extracted frame return and can determine the extraction of another frame.

Advantageously can the rotation of said shaft (4) be directly controlled by said one pedal (7), which oscillates from a rest position to a temporary activation position, in which said pedal (7) is depressed.

As a matter of fact, the combined brush (1) possibly comprises a pedal (7) which, while the accessories are used, is held lifted by a spring (73) whereas, operated by the foot, it moves downwards, so as to operate an oblique sprocket wheel (41) integral with said shaft (4), whereby the intermittent rotation of the latter is caused.

In order to prevent the presence of unavoidable clearances between the elements of the mechanisms present in the combined brush (1) from originating an unstable extracted position, said brush possibly comprises a special wheel (42), integral with said shaft (4), onto which a projecting ridge acts upon reaching the extracted position.

BRIEF DESCRIPTION OF THE DRAWINGS

FIG. 4 and FIG. 11 are also visible in the right-hand side of the figure.

FIG. 7 shows a cross-section view of the combined brush represented in FIG. 6, which highlight the action of the cam (5) onto its respective cam follower, in this case directly realized on the frame (10). If the latter is in its extracted position, then the frame (11) is held in its retracted position by one or several return springs, no contact existing between the cam (6) and its respective cam follower. The same figure also shows the fixed part (2) and the pedal (7).

FIG. 8 shows a cross-section view of the combined brush represented in FIG. 6, in which the frame (10) is represented in its extracted position. This cross-section view highlights the cam (6) and its respective properly shaped cam follower machined on the frame (11). Since there is no contact between the cam (6) and its respective cam follower, the frame (11) is retracted thanks to the action of one or several return springs. The figure also shows the fixed part (2) and the pedal (7).

DETAILED DESCRIPTION OF AN EMBODIMENT OF THE INVENTION

Figure 1:
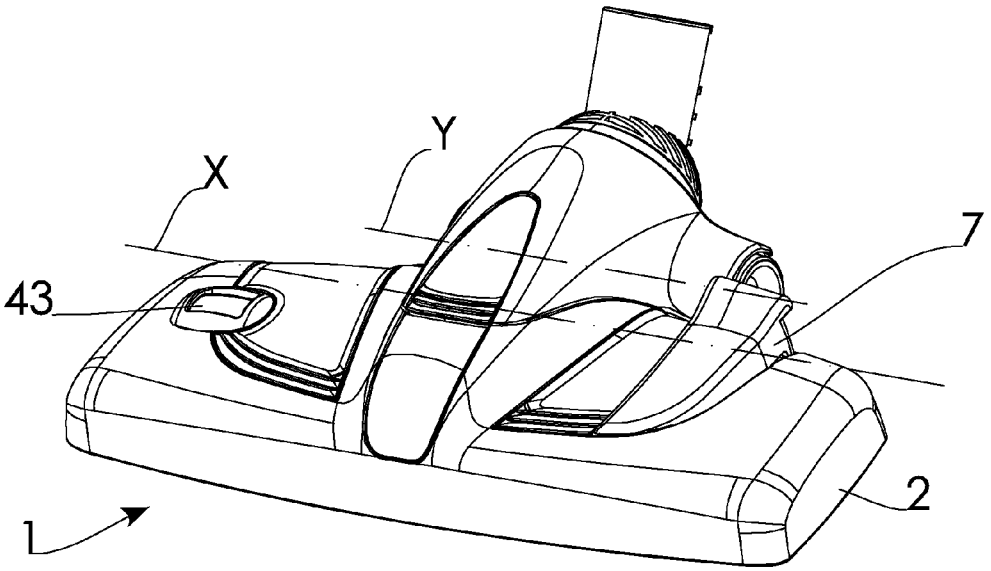
FIG. 1 shows an axonometric view of the combined brush (1) according to the present patent application. The figure clearly shows the one pedal (7), the fixed part (2), and an indicator element (43). The two axes of articulation (X, Y) are also visible.
Figure 2:
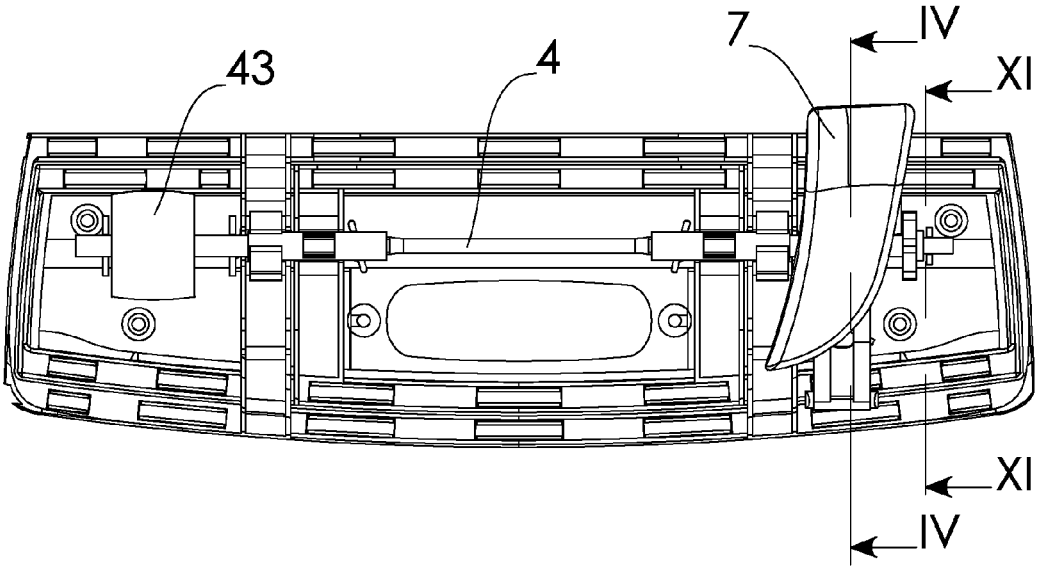
FIG. 2 shows a top view of the combined brush (1) which allows to lock inside it, some pieces of the fixed part (2) having been partially removed. The pedal (7), the shaft (4), and the indicator element (43) can be identified in the figure. The traces of the cross-section planes as per
Figure 3:
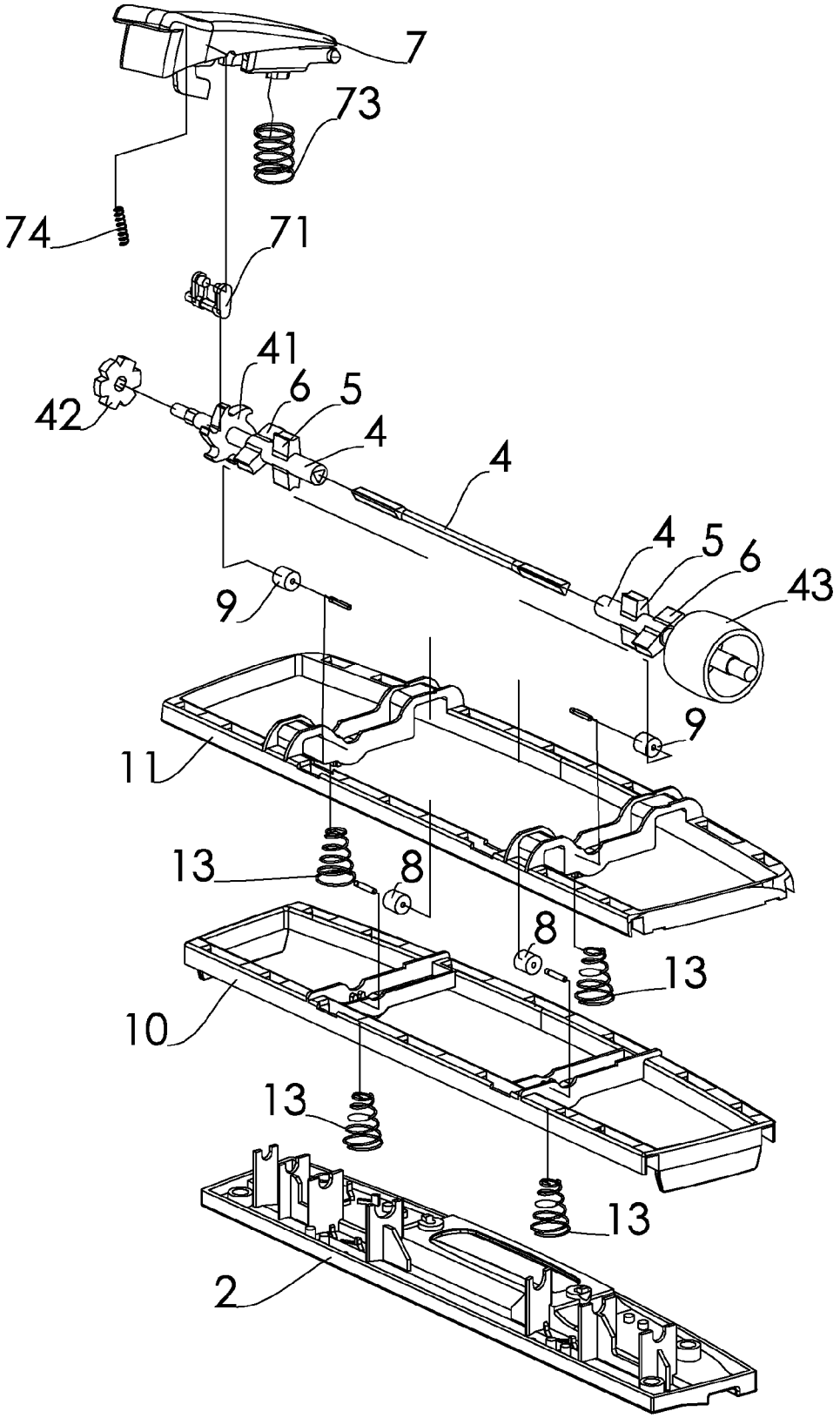
FIG. 3 shows an exploded view of the inner part of the combined brush (1), the fixed part (2) being only partially visible. The figure makes it possible to infer the principle of operation of the device according to the present patent application. In order to make its understanding easier, some elements have been removed. For instance, the two movable frames have no accessories, e.g. blades, strip brushes, or the like. Conversely, the figure shows the return springs (13), the pedal spring (73), the wheel tappets (8, 9), the cams (5, 6), the three parts composing the shaft (4), the two frames (10, 11), the oblique sprocket wheel (41), the special wheel (42), and the indicator element (43). Further, the one pedal (7) with a pawl (71) and a spring (74) are visible on the top.
Figure 4A:
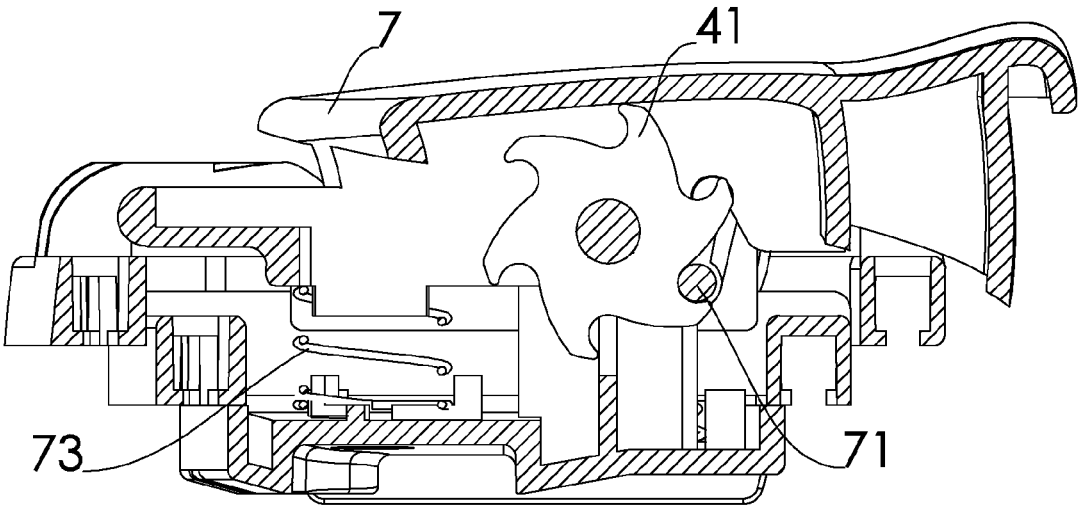
FIG. 4A shows a cross-section view of the brush, in which one can see the pedal (7) in its depressed position, the spring (73), and the pawl (71) which puts the oblique sprocket wheel (41) into rotation.
Figure 4B:
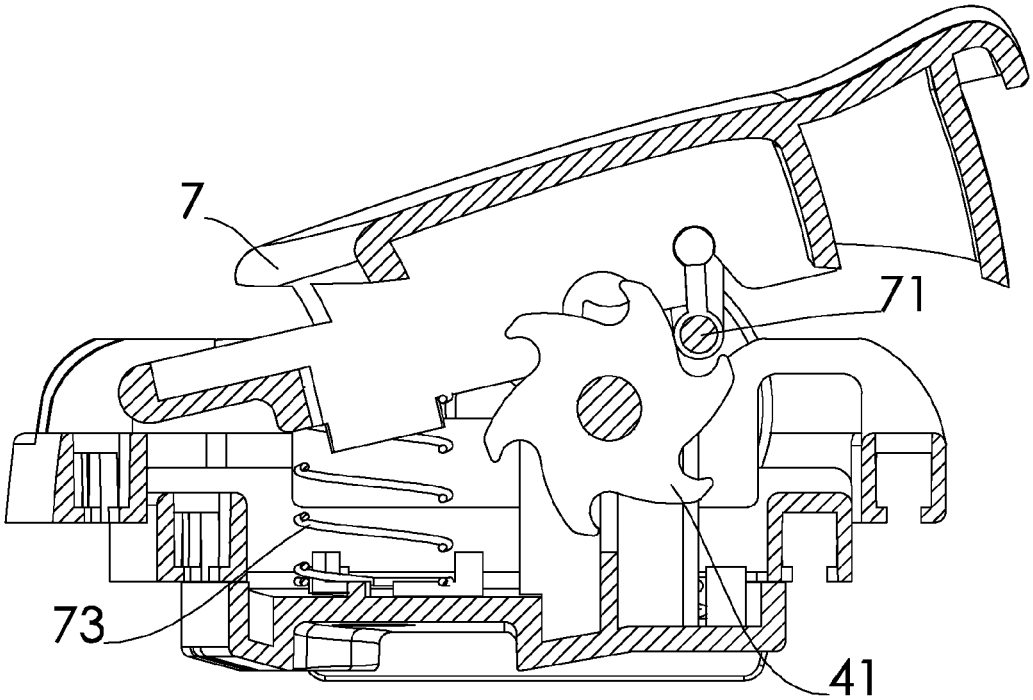
FIG. 4B shows a cross-section view of the brush, in which one can see the pedal (7) in its rest position, the spring (73), and the pawl (71) not in operation.
Figure 5:
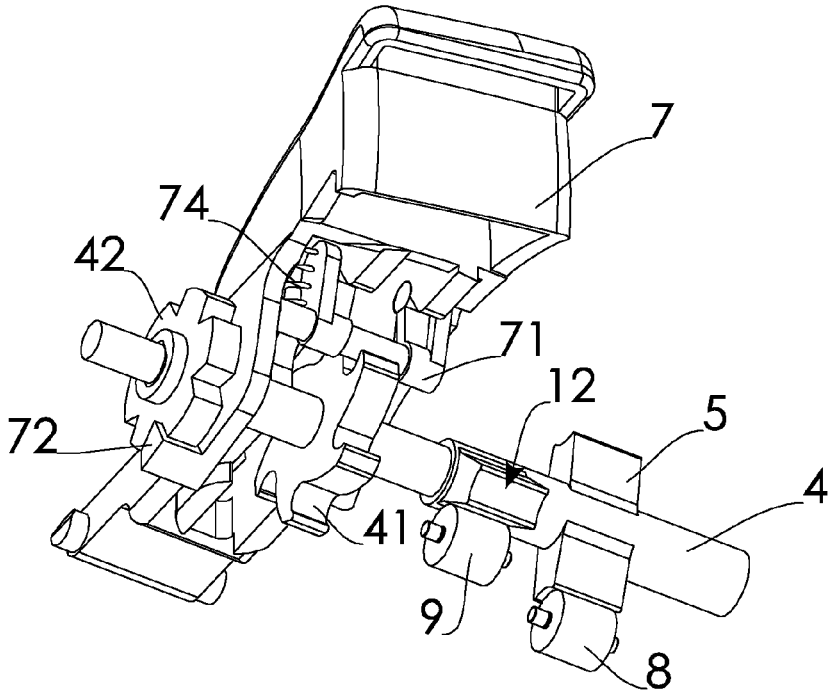
FIG. 5 shows an axonometric bottom view of the pedal (7) and of the elements involved in the operation of the two movable frames (10, 11). Besides an end of the shaft (4), the cam (5), and the wheel tappets (8, 9), this view illustrates the operation of the special wheel (42) in cooperation with the projecting ridge (72). The figure also shows the spring (74) which caters for the positioning of said pawl (71) with respect to said oblique sprocket wheel (41).
Figure 6:
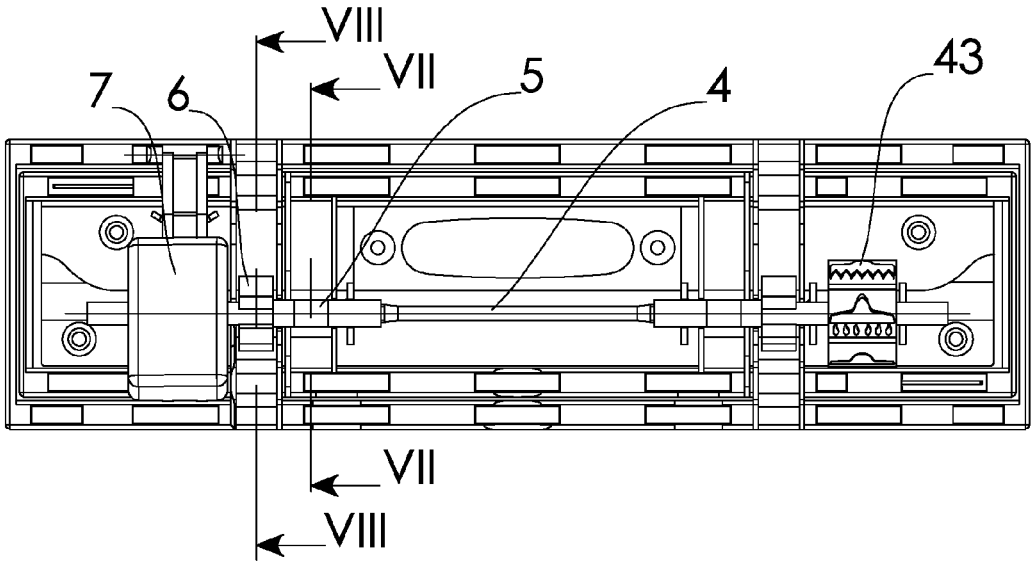
FIG. 6 shows a top view of an embodiment of the combined brush (1), in which the cams (5, 6) act directly onto the frames. This figure makes it possible to look inside the brush, some pieces of the fixed part (2) having been partially removed. The figure shows the pedal (7), the shaft (4), and the indicator element (43). Also, the traces of the cross-section planes as per
Figure 7:
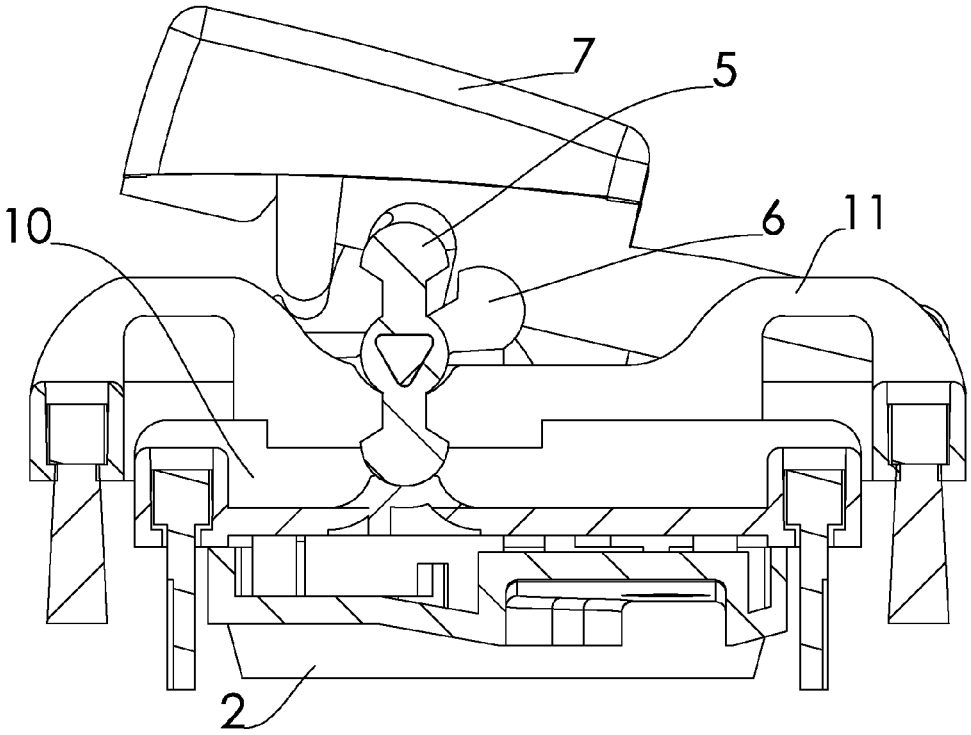
FIGS. 7 and 8 are visible on the left.
Figure 8:
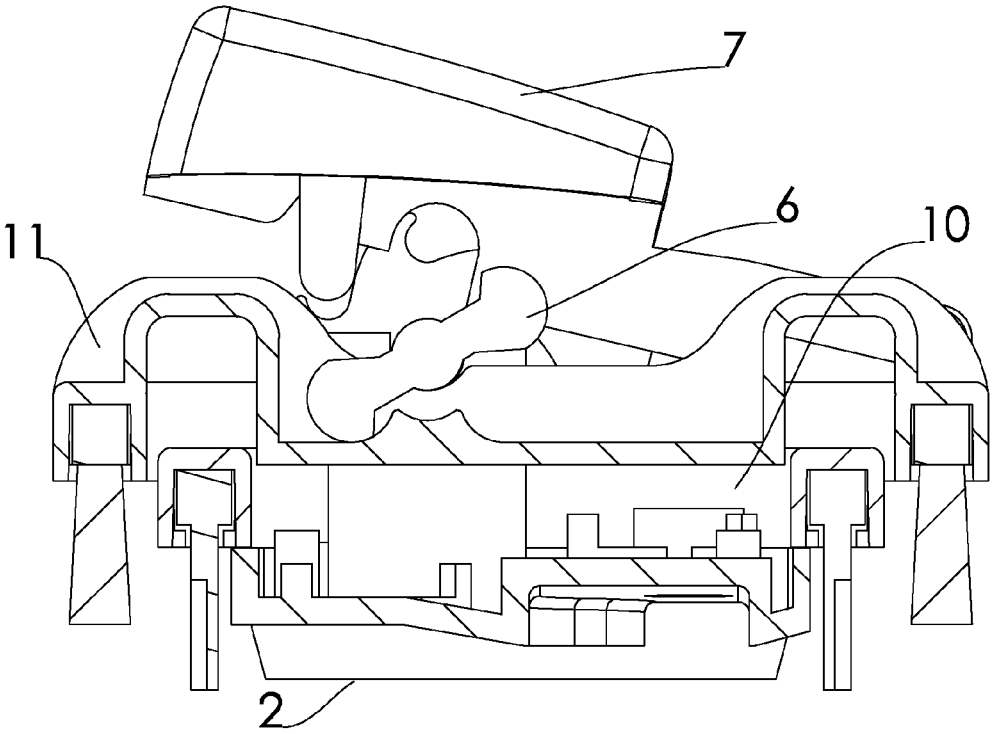
Figure 9:
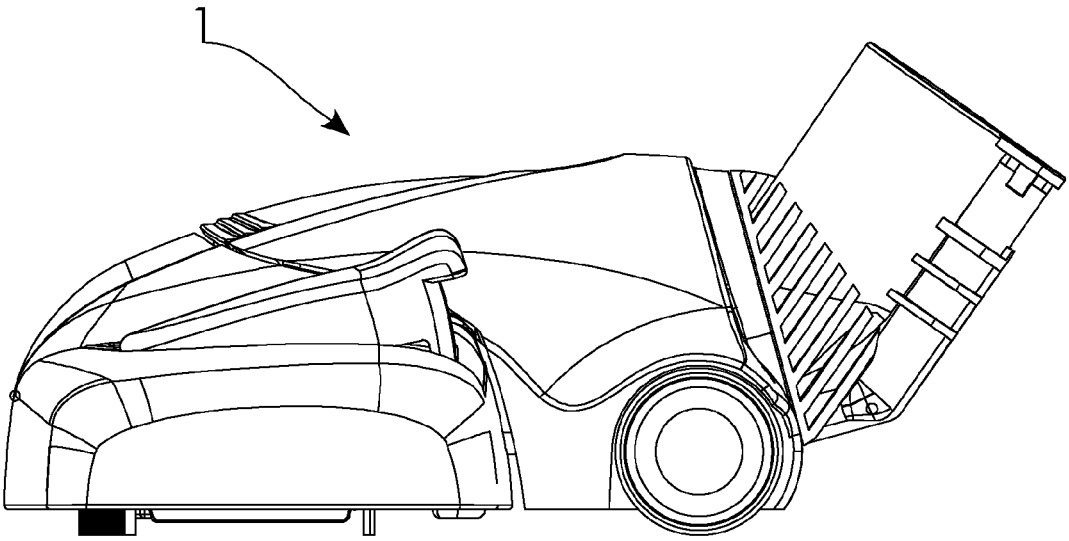
FIG. 9 shows a side view of the double-articulation combined brush (1) according to the present patent application.
Figure 10:
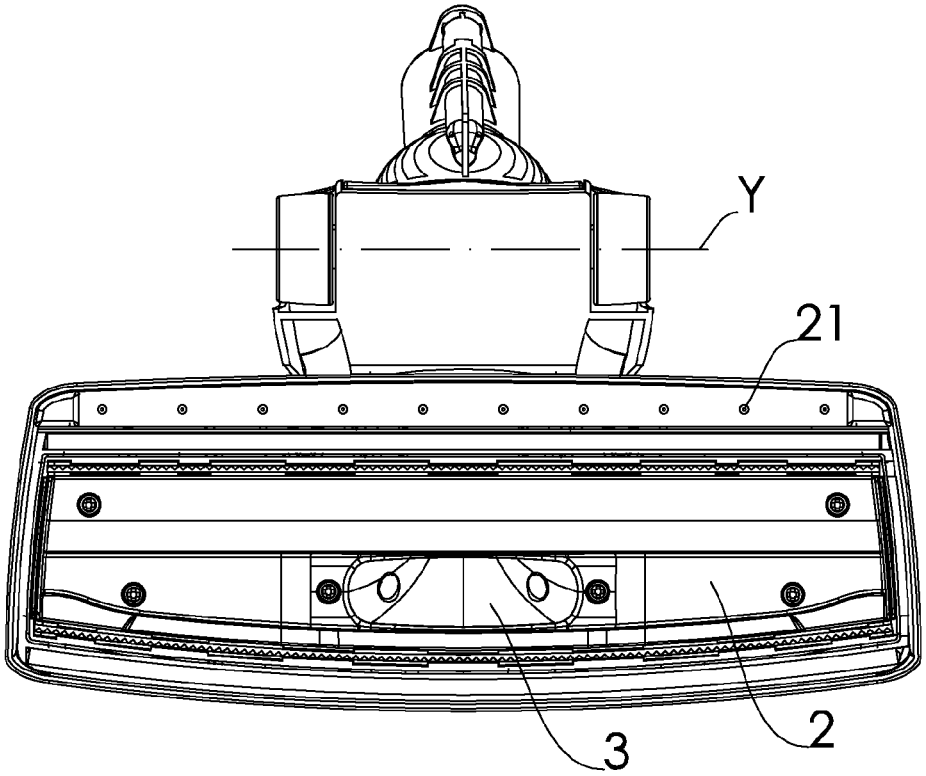
FIG. 10 shows a bottom view of the combined brush (1) which highlights the inlet part of the suction duct (3), the steam outlet nozzles (21) machined on the fixed part (2), and the axis of articulation (Y).
Figure 11A:
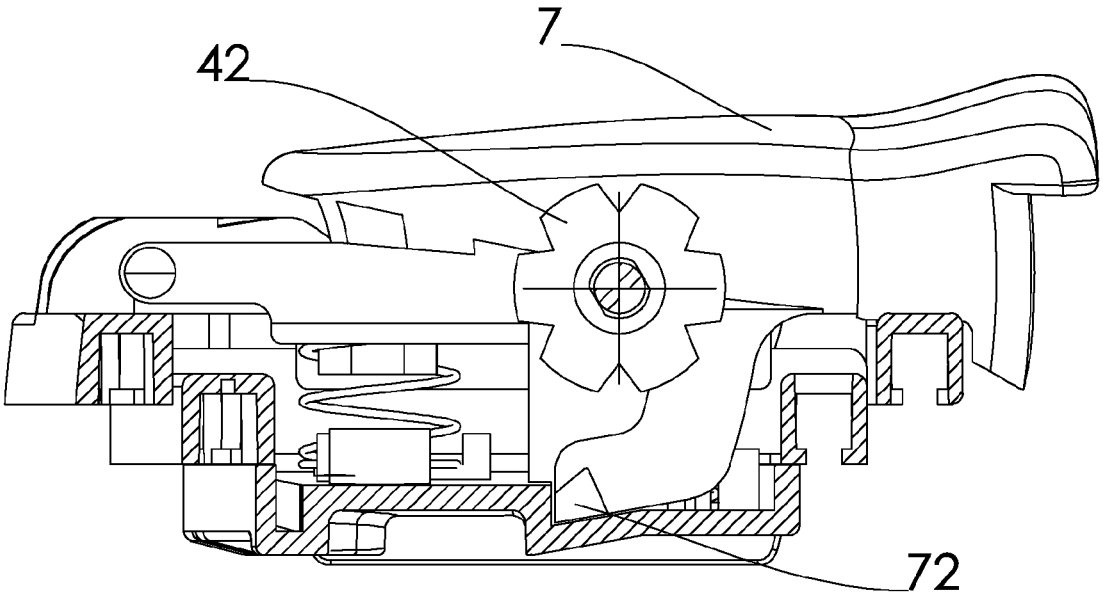
FIG. 11A shows a cross-section view of the brush which highlights the pedal (7) in its depressed position, the special wheel (42), and the specially designed projecting ridge (72) which does not engage in the notches of said special wheel (42).
Figure 11B:
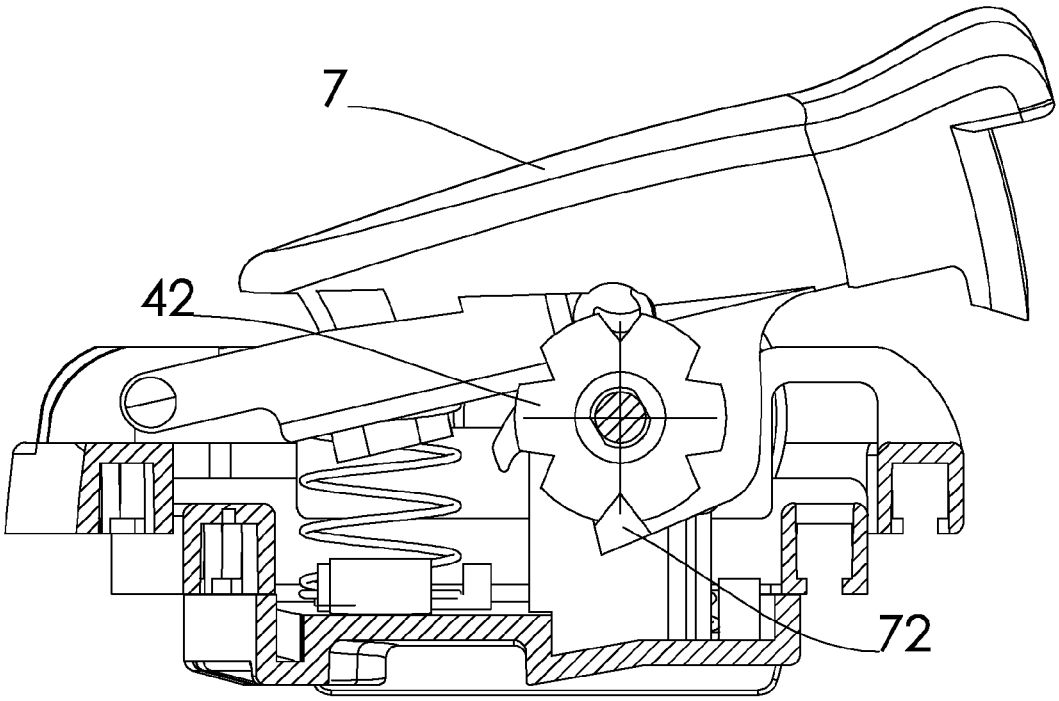
FIG. 11B shows a cross-section view of the brush which highlights the pedal (7) in its rest position and the specially designed projecting ridge (72) which engages one of the notches of said special wheel (42).

The combined brush (1) according to the present application comprises a fixed part (2) and one or several frames (10, 11), preferably two or more frames, movable with respect to the latter.

The fixed part (2) can be composed of several pieces properly joined to each other, for instance by means of adhesives, joints, screws, or other connection means.

In the embodiment here described, and represented in the figures, the fixed part (2) comprises a lower piece joined to an upper piece via threaded connections. Said lower piece is properly shaped so as to provide a first operating mode of the brush, usually referred to as "for carpets". A suction inlet of the suction duct (3) and a number of nozzles (21) for steam exhausting purposes are also present on said lower piece.

The fixed part (2) presents a number of appropriate openings in order to make the extraction of the remaining frames possible. In particular, in the embodiment here described the brush (1) is equipped with two frames (10, 11) which move from a retracted position to an extracted position with respect to said fixed part (2). A first frame (10) is specially suited for cleaning floors, being equipped with strip brushes. Conversely, a second frame (11) is equipped with blades which are usually employed because they allow to delimit the volume during liquid suction.

On the basis of what just proposed, the combined brush (1) here described provides three operating modes which are particularly advantageous whenever a vacuum cleaner is to be used also for liquids or is provided with steam generation facilities. More specifically, said brush is provided with a duct for the steam that is exhausted via a number of nozzles (21) and, consequently, shall then be sucked, together with the air, through the suction duct (3).

The movement of the frames, which is an alternating translatory one, is controlled by the intermittent rotation of a shaft (4), placed inside the fixed part. As a matter of fact, said shaft (4) moves two first flat cams (5) and two second flat cams (6) integral with said first frame (10) and with said second frame (11) respectively. Said cams (5, 6) are coaxially integral with said shaft (4), so that the rotation of the latter enables them to cooperate with cam followers of a translating type, the latter possibly directly machined on the two frames (10, 11) or alternatively consisting of components directly connected, also rotationally wise, to said frames. In particular, in the embodiment here described, said cam followers are implemented in the form of wheel tappets (8, 9) each rotating with respect to its respective axis integral with the frame.

The contact between said cams (5, 6) and their corresponding cam followers (8, 9) is provided by at least one return spring (13) which pushes its respective movable frame toward its retracted position. In the embodiment here described every frame is provided with two return springs (13). Furthermore, every cam (5, 6) determines two different angular positions, each of which determines the extraction of its respective frame.

Alternatively, said cams can be properly shaped in such a way that said frames (10, 11) behave as translating cam followers, without using any separate tappets. Advantageously can said frames assume configurations that facilitate the movements operated by said cams or allow to stabilize the assumed position.

In the embodiment here described, each of said cams presents a notch (12) on the contact surface. In each of said two different angular positions said notch receives, following an elastic deformation, its respective wheel tappet.

The elastic deformation can be confined between the notch (12) and the cam follower or, advantageously, the return springs, connected to each one of said two frames (10, 11), can get elastically deformed so that every notch (12) can receive its corresponding cam follower.

If the translating cam followers are machined directly on one or several frames, then the surface in contact with its corresponding cam can present a notch to engage it, following an elastic deformation, so as to hold it in at least one working angular position, corresponding to the extracted position of its respective movable frame. In this case too, the elastic deformation can be confined between the notch and the cam or advantageously can the return springs, connected to the frame, get elastically deformed.

In the embodiment here described, the first cams (5) and the second cams (6) form angles of 60 degrees between them so as to allow, by way of successive intermittent rotations of said shaft (4), the comeback of said second frame (11) and the extraction of said first frame (10), the comeback of said first frame (10), the extraction of said second frame (11), and so on, an operating mode corresponding to every position.

Anyway, the number of the cams, their angular configuration, and the number of the extracted positions determined by every cam are characteristics that can vary for a number of reasons, for instance, as a function of the desired features. Or even more, the shaft might rotate both forward or backward, or rotate every time by angles different from those indicated above. All of these configurations can be easily determined on the basis of the information contained in the present patent application.

A further advantageous feature of the brush (1) is represented by the possibility of operating the rotation of said shaft (4) just by means of one pedal (7) hinged onto said fixed part (2) and capable of describing an oscillatory motion.

Advantageously can said oscillatory motion take place thanks to a spring which brings said one pedal (7) back to the rest position after the external depression.

Depressing said one pedal (7) causes, via a ratchet gear, the intermittent rotation of said shaft (4). More in details, an oblique sprocket wheel (41), coaxially integral with said shaft (4), is put into a progressive rotation by a pawl (71) driven by said one pedal (7). While the pedal is depressed, said pawl (71) gets in contact with an oblique sprocket of said wheel (41) and makes it rotate.

Advantageously, in the embodiment here described a spring (74) guarantee the contact between said pawl (71) and said wheel (41).

Whenever, by depressing the pedal (7), one of said two frames (10, 11) is extracted, the pawl (71) drives the shaft (4), via the oblique sprocket wheel (41), into such a position that at least one cam follower is received in a corresponding hollow (12) of its respective cam.

In a particularly complete embodiment, in order to make this position stable, it is possible to coaxially and integrally connect to said shaft (4) a special wheel (42) whose circumference presents a number of notches, one of which engages a specially designed projecting ridge (72) present in the lower part of said one pedal (7) whenever it is in its rest position, so as to prevent said shaft (4) from rotating.

The solutions adopted in the combined brush (1) according to the present patent application make it possible to use an operating mode indicator element (43), i.e. an element that indicates the position of said one or several frames, simple to manufacture, install, and customize.

As a matter of fact, said indicator element (43) is possibly coaxial to said shaft (4) and possibly presents a side surface subdivided into sectors, each of which identifies a different operating mode. This way, rotating said shaft (4) makes it possible to vary the sector that is visible. The figures show a particular indicator element (43) featuring a cylindrical shape visible outside the fixed part (2) through a transparent slot which might even be just an opening in said fixed part (2).

Further, the solutions here presented offer special advantages when they are used in a combined brush (1) that is operationally connected to the vacuum cleaner via a double articulated joint, rotating with respect to a first axis (X) and to a second axis (Y). As a matter of fact, said double articulated joint cooperates with the intermittent rotation of said shaft (4) so as to quickly and easily match the operating mode to the different conditions, for instance when passing from a floor to a carpet.

In an alternative embodiment, said shaft (4) and consequently the frames associated therewith are driven electrically.

The invention claimed is:

1. A combined brush for vacuum cleaner comprising at least one suction duct, one fixed part, and two or several frames, each movable with respect to said fixed part from a retracted position to an extracted position, wherein each of said two or several movable frames is extracted or retracted according to an alternating translatory movement controlled by the intermittent rotation of a shaft, wherein the extraction of each movable frame takes place at at least one angular position of said shaft, said at least one angular position being different from the angular positions at which the other or the other movable frames are extracted.

2. The brush according to claim 1, wherein said alternating translatory movement takes place by means of one or several flat cams, wherein each flat cam is associated with a cam follower, wherein further each flat cam is coaxially integral with said shaft and respectively cooperating with one of said two or several movable frames and whose cam followers are translational cam followers.

3. The brush according to claim 2, wherein said one or more flat cams are rotational flat cams, the center of rotation placed on the axis of said shaft, each of said flat cams lying on a different plane orthogonal to said axis of said shaft.

4. The brush according to claim 2, wherein the contact between said flat cams and their corresponding cam followers is kept by at least one return spring which pushes its respective movable frame towards the retracted position.

5. The brush according to claim 3, wherein the contact between said flat cams and their corresponding cam followers is kept by at least one return spring which pushes its respective movable frame towards the retracted position.

6. The brush according to claim 2, wherein the contact area between at least one of said flat cams and its respective cam follower features a hollow, obtained in the flat cam or alternatively in the cam follower, suitable for engaging said flat cam in at least one working angular position, corresponding to the extracted position of its respective movable frame.

7. The brush according to claim 6, wherein said engagement of said flat cam takes place via a deformation of specially provided elastic means.

8. The brush according to claim 7, wherein said specially provided elastic means comprise at least one return spring suitable for being elastically deformed.

9. The brush according to claim 2, wherein said translating cam followers are realized in the form of wheel tappets.

10. The brush according to claim 2, wherein said translating cam followers are directly machined on said two or several movable frames.

11. The brush according to claim 1, wherein the rotation of said shaft is induced, via a ratchet gear, by the rotation of one pedal hinged onto said fixed part and capable of performing an oscillatory movement, wherein said one pedal acts on an oblique sprocket wheel, coaxially integral with said shaft, so as to give it, via a pawl, an intermittent progressive rotation.

12. The brush according to claim 11, further comprising at least one spring which is elastically deformed so as to keep the correct positioning of said pawl with respect to said oblique sprocket wheel.

13. The brush according to claim 11, further comprising a special wheel coaxially integrated with said shaft and comprising a plurality of hollows arranged along its circumference, wherein said one pedal features a projection suitable for engaging one of the hollows arranged along the circumference of the special wheel, wherein said pedal oscillates from a rest position to a temporary activation position in relation to rotation of said shaft, wherein the rotation of said shaft is prevented whenever said pedal is in its rest position.

14. The brush according to claim 11, characterized in that wherein said one pedal is brought back to its rest position by a spring.

15. The brush according to claim 11, wherein said alternating translator movement takes place by means of one or several flat cams, wherein each flat cam is associated with a cam follower, wherein further each flat cam is coaxially integral with said shaft and respectively cooperating with one of said two or several movable frames and whose cam followers are of a translating type.

16. The brush according to claim 15, wherein said one or more flat cams are of rotational type, with the center of rotation placed on the axis of said shaft, each of said flat cams lying on a different plane orthogonal to said axis of said shaft.

17. The brush according to claim 16, wherein the contact between said flat cams and their corresponding cam followers is kept by at least one return spring which pushes its respective movable frame towards the retracted position.

18. The brush according to claim 17, wherein the contact area between at least one of said flat cams and its respective cam follower features a hollow, obtained in the cam or alternatively in the cam follower, suitable for engaging said flat cam in at least one working angular position, corresponding to the extracted position of its respective movable frame.

19. The brush according to claim 1, further comprising an indicator element, coaxially integral with said shaft, whose lateral surface is subdivided into a number of sectors of a circle, each of them identifying a different angular position of said shaft.

20. The brush according to claim 19, wherein the rotation of said shaft is induced, via a ratchet gear, by the rotation of one pedal hinged onto said fixed part and capable of performing an oscillatory movement, wherein said one pedal acts on an oblique sprocket wheel, coaxially integral with said shaft, so as to give it, via a pawl, an intermittent progressive rotation.

21. The brush according to claim 1, wherein the connection to the vacuum cleaner is made by a double articulated joint, able to rotate with respect to a first axis and a second axis.

* * * * *